United States Patent [19]

Rear

[11] Patent Number: 4,921,052

[45] Date of Patent: May 1, 1990

[54] DOWNHOLE RECIRCULATING HAMMER

[76] Inventor: Ian G. Rear, 60 Clavering Road, Bayswater, Australia

[21] Appl. No.: 328,116

[22] Filed: Mar. 23, 1989

[30] Foreign Application Priority Data

Mar. 24, 1988 [AU] Australia ..... PI7422

[51] Int. Cl.[5] ..... E21B 4/06

[52] U.S. Cl. ..... 173/78; 173/80; 175/215

[58] Field of Search ..... 173/16, 17, 66, 67, 173/73, 77, 78, 79, 80; 175/215

[56] References Cited

U.S. PATENT DOCUMENTS 3,795,283 3/1974 Oughton ..... 173/80 X 3,941,196 3/1976 Curington et al. ..... 175/215 X 3,991,834 11/1976 Curington ..... 173/80 X

*Primary Examiner*—Douglas D. Watts

*Assistant Examiner*—Rinaldi Rada

*Attorney, Agent, or Firm*—Harness, Dickey & Pierce

[57] ABSTRACT

A downhole reverse circulation hammer is provided comprising a tubular housing and a top sub and drill bit supported mounted on either end of the housing. A central axis tube extends through the housing, top sub and drill bit support and a piston is slidably positioned in the tube. The hammer has a network of fluid passageways and spaces which enable the piston to reciprocate against an anvil in response to the entry and exit of a fluid into the spaces via the passageways.

4 Claims, 3 Drawing Sheets

DOWNHOLE RECIRCULATING HAMMER

BACKGROUND OF THE INVENTION

1. Technical Field:

This invention relates to fluid operated downhole hammers and in particular hammers of the reverse circulation type.

2. Background Information:

Reverse circulation hammers are designed to pass rock cuttings and detritus from ground formations being drilled through the center of the hammer in order that uncontaminated samples of the well formation being drilled are passed to the surface or outer atmosphere for collection without passing out through the annular space formed between the walls of the hole being drilled and the hammer and casing connecting the hammer to the drill machine at the surface.

SUMMARY OF THE INVENTION

In one form the invention resides in a fluid operated hammer comprising a tubular housing, a top sub mounted at one end of the housing and a drill bit support mounted to the other end of the housing, said drill bit support and top sub having central axial passageways therein, a central tube extending through the housing between the top sub and drill bit support and communicating with said central axial passageways provided therein, a feed tube concentrically received over the central tube and mounted to the top sub to extend into the housing and terminate intermediate of the top sub and drill bit support, fluid flow passageways provided through the drill bit support between the inner and outer ends thereof, a piston slidably received with the housing over the feed tube for reciprocation between a first position adjacent the top sub and a second position abutting the drill bit support, the end portion of the piston adjacent the drill bit support having a reduced diameter and the inner walls of the housing adjacent the drill bit support having a reduced diameter portion complementary to the end portion of the piston, fluid porting means in the feed tube and piston to sequentially admit fluid into a first space between the top sub and piston and into a second space between the reduced diameter portion of the piston, the side walls of the housing and the inner end of the reduced diameter portion of the housing, and causing reciprocation of the piston between the second and first positions respectively, wherein the reduced diameter portions of the piston and the housing are engaged with each other when said piston is at said second position and wherein the reduced diameter portions of the piston and housing disengage when the piston is at an intermediate position to allow for escape of fluid from the second space through the fluid passageways.

BRIEF DESCRIPTION OF THE DRAWINGS

The invention will be more fully understood in the light of the following description of one specific embodiment. The description is made with reference to the accompanyiny drawings of which.

DESCRIPTION OF PREFERRED EMBODIMENTS

Figure 1:
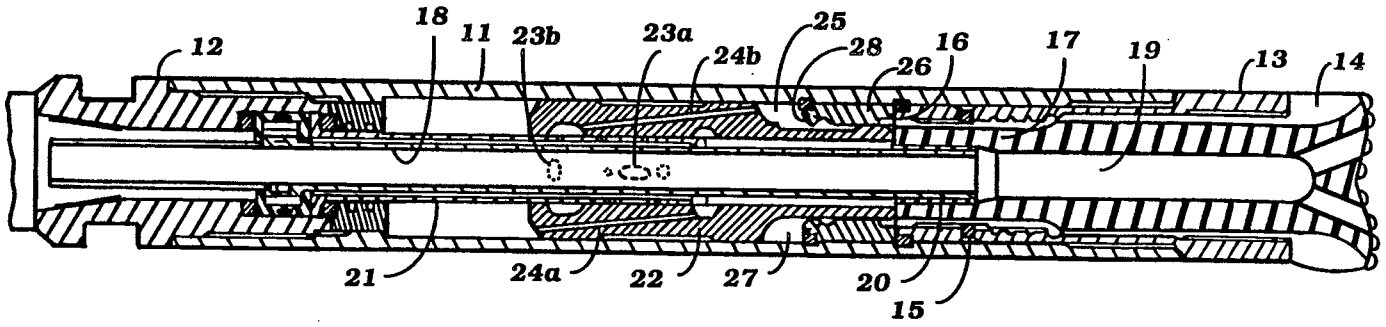
FIG. 1 is a sectional elevation of the hammer in the impact position.

The embodiment is directed to a reverse circulation downhole hammer comprising a substantially tubular housing 11 with a top sub 12 mounted to one end and a drill bit support 13 mounted at the other end. The drill bit support accommodates a drill bit 14 which is axially slidable within the drill bit support and is retained in the drill bit support through a bit retaining ring in the drill bit support engaging an enlargement 16 provided on the anvil 17. The engagement between the drill bit chuck 13 and the drill bit 14 is through a series of mating splines which provide a fluid flow between the inner end of the drill bit chuck 13 and the outer end thereof.

Figure 2:
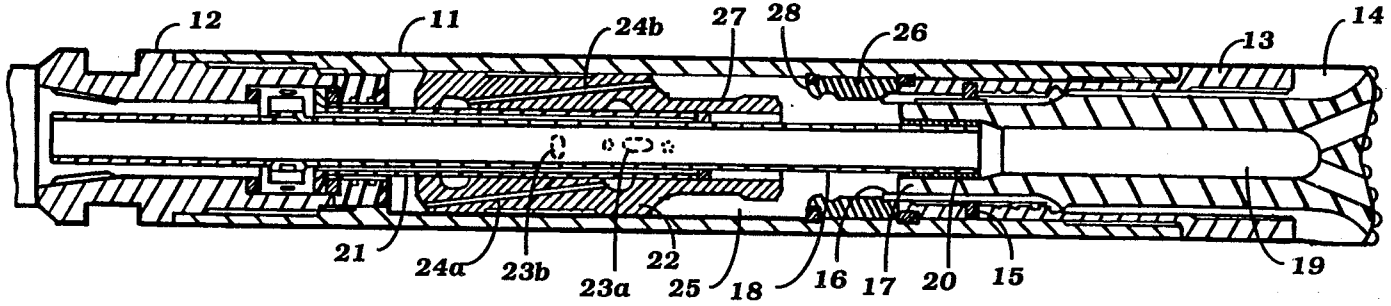
FIG. 2 is a sectional elevation of the hammer with the piston in the raised position.

The top sub 12 supports a central tube 18 which extends through the top sub and through the housing to be slidably engaged within the central axial bore 19 of the drill bit 14. The end of the central tube 18 which is located in the region of the top sub 12 is adapted for engagement with the drill string and/or a cross over sub. The portion of the bore 19 of the drill bit 14 which slidably engages the central tube 18 is provided with an annular bush 20 which slidably and sealingly engages the outer face of the central tube 18. The top sub 12 also supports a feed tube 21 which extends from the top sub 12 concentrical)y over the central tube 18 and terminates intermediate of the top sub 12 and the drill bit chuck 13. The feed tube is connected through the top sub to a pressurized fluid supply. Seals are provided at the innermost end of the feed tube 21 for engagement with the outer face of the central tube 18 to close off the inner end of the feed tube. The housing slidably supports a piston 22 which is slidably and sealingly receivable over the feed tube 21 for reciprocation between a position at which it is in close abutting relationship with the anvil 17 of the drill bit 14 (i.e. the impact position as shown at FIG. 1) and a raised position where its other end is closely adjacent the top sub (i.e. the raised position as shown at FIG. 2). The walls of the feed tube are provided with two sets of apertures 23*a* and 23*b*. The first set of apertures 23*a* comprises three or more subsets of axially spaced apertures of differing dimensions which periodically and sequentially are brought into engagement with a first set of passageways 24*a* in the piston 22 to allow for admission of fluid into the first space between the top sub and the other end of the piston. The second set of apertures 23*b* comprises a single sub-set of apertures which are periodically brought into engagement with a second set of passageways 24*b* in the piston which provides for the admission of fluid into the space at the one end of the piston. The end portion 25 of the one end of the piston 22 is formed with a reduced diameter and is associated with an annular piston stem seal bearing 26 located adjacent the inner end of the drill bit chuck 13 to define a portion of the inner face of the housing of reduced diameter which has a complementary diameter to that of the reduced diameter end portion 25 of the piston 22. The outer face of the reduced diameter and portion 25 of the piston is formed with a set of circumferentially spaced axial scallops or flutes 27 while the inner end of the piston stem seal bearing is formed with a set of circumferentially spaced axial flutes 28.

Figure 3:
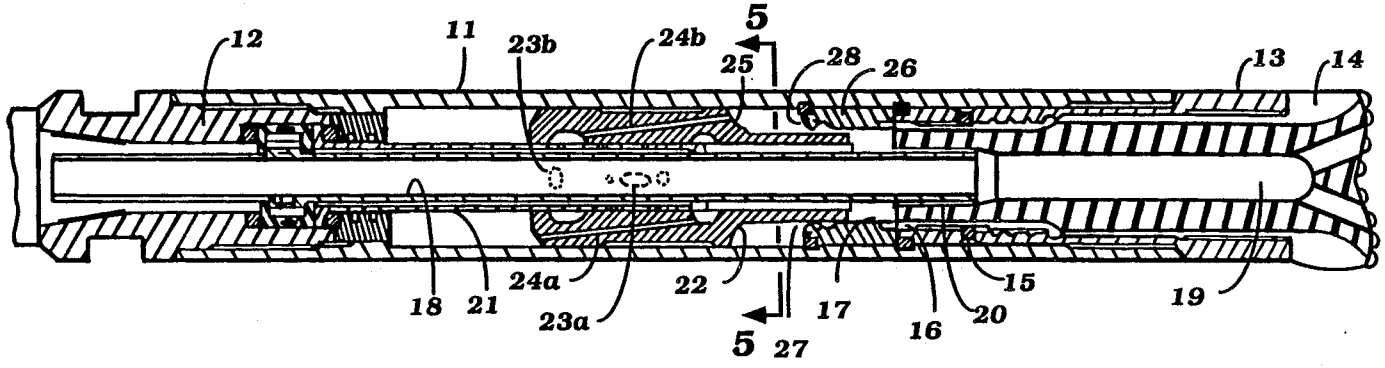
FIG. 3 is an additional elevation of the piston at an intermediate position.

When in the impact mode as shown at, fluid is admitted into the second space defined between the reduced diameter end portion 25 of the piston, the inner end of the stem seal bearing 26 and the side wall of the housing 11 to increase the fluid pressure therein and drive the piston towards the top sub end. Such driving action is maintained until the end of the reduced diameter end portion 25 of the piston is engaged with the flutes 28 of the piston stem seal bearing 26 at which time fluid in the second space is caused to exhaust from the housing through the fluid passageways defined between the drill bit and drill bit chuck. Subsequently fluid is sequentially admitted into the first space between the top sub and the other end of the piston to slow the piston down, stop the piston, and subsequently drive the piston towards the anvil 17 of the drill bit 14. At an intermediate position as shown at FIG. 3 the first space opens into the central bore of the piston 22 through the first set of passageways 24*a* and fluid is permitted to exhaust therefrom into the space between the lower end of the anvil and the one end of the piston 22 whereby it is then exhausted through the fluid passageway between the drill bit 14 and drill bit support 13. At this point in time the second space has been sealingly isolated by engagement of the end of the reduced diameter end portion 25 with the side walls of the piston stem seal bearing 26 whereby after impact fluid admitted into the second space again causes the piston to be raised towards the top sub end to the raised position as shown at FIG. 2.

Figure 4:
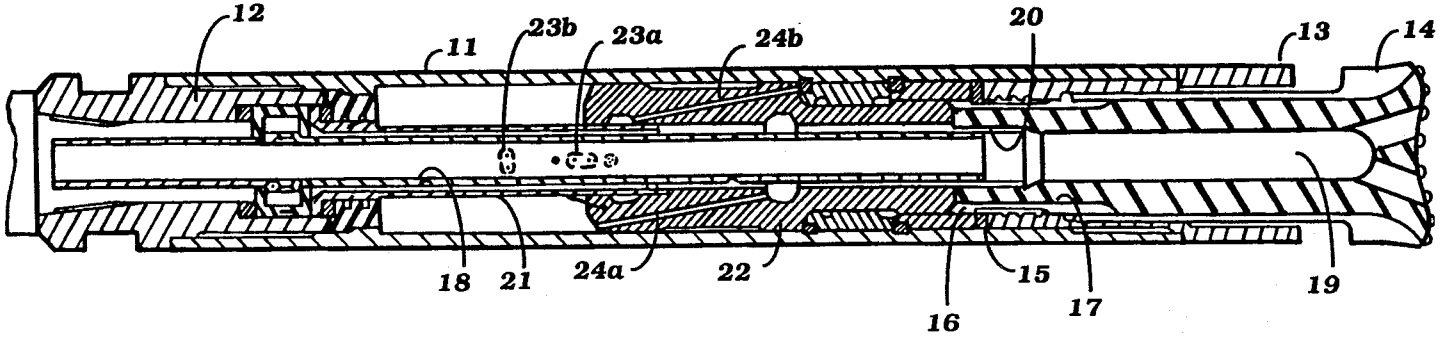
FIG. 4 is a sectional elevation of the hammer in the blowdown position.
Figure 5:
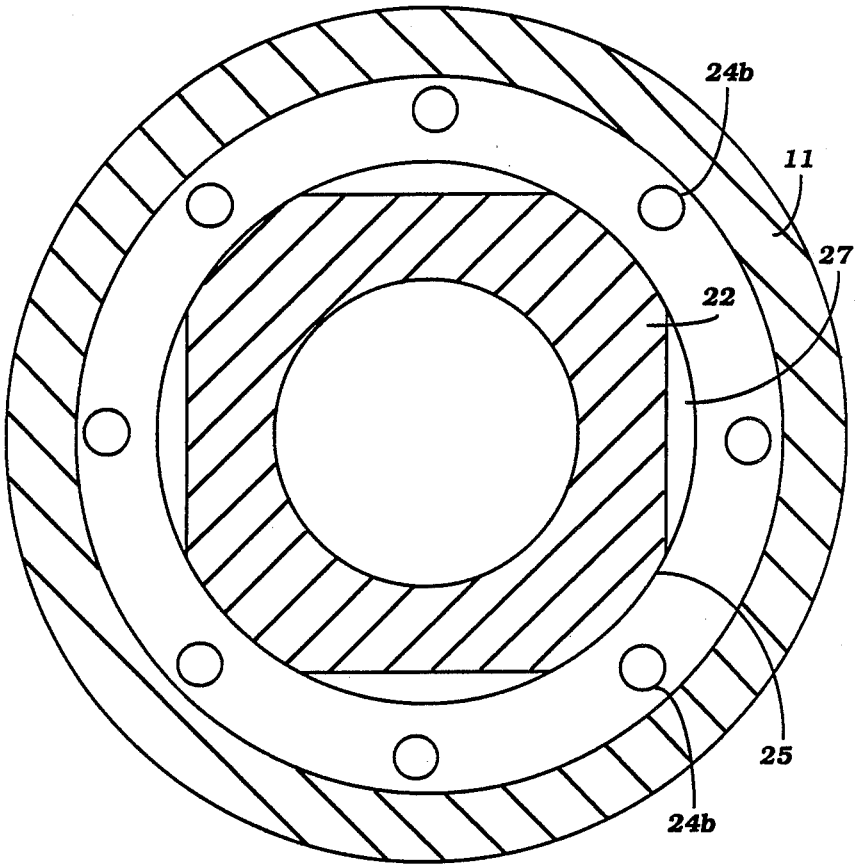
FIG. 5 is a cross section along lines 5—5 of FIG. 3.

When in the blowdown position as shown at FIG. 4, whereby the drill bit 14 is allowed to drop away from the lower end of the drill bit support 13, such that the flange 18 of the anvil 17 is in engagement with the drill bit support rings 15, the piston is brought into close abutting relationship with the piston stem seal bearing. The piston is maintained in that position as a result of fluid being admitted directly from both the first and second set of apertures 23*a* and 23*b* into the first space between the top sub 12 and the other end of the piston. Such fluid is caused to exhaust from that first space through the first set of passageways into the central bore of the piston and then through the fluid passageways provided between the drill bit support 13 and drill bit 14. In addition the lowermost aperture of the first set of apertures 24*a* communicates through the second set of passageways 23*b* in the piston with the second space between the reduced diameter portion 25 and the piston stem seal bearing 26, enabling flow through the flutes 28 provided in the reduced diameter portion 25 and then to the fluid passageway between the drill bit chuck 13 and drill bit 14.

The continued impact of the piston on the anvil of the bit exerts a continual repetitive force by the cutting end of the bit on the rock in the ground formation with which the bit is in contact, causing the rock to spall or break and be dislodged. The outside diameter of the housing and hammer assembly is only marginally smaller than the drill bit cutting diameter and the spalled rock or dislodged ground formation, forms a small annular area which restricts or stops the passage of the rock detritus from travelling upwards past the exterior face of the hammer assembly. The holes in the face of the drill bit connected to the inner bore of the bit and in turn to the inner tube of the hammer offer unrestricted access to the surface with a subsequent large pressure drop between the high pressure fluid being passed to the hammer and exiting past the splines of the bit and chuck and the outer atmosphere at the surface. This causes the rock detritus to pass out through the inner tube of the hammer allowing the bit cutting head to have free contact with fresh rock or undisturbed ground formation.

It should be appreciated that the scope of the present invention need not be limited to the particular scope of the embodiment described above.

I claim:

1. A fluid operated hammer comprising a tubular housing, a top sub mounted to one end of the housing and a drill bit support mounted to the other end of the housing, said drill bit support and top sub each having a central axial passageway therein, a central tube extending axially through the housing between the top sub and drill bit support and communicating with said central axial passageways of said drill bit support and top sub, a feed tube concentrically received over the central tube and mounted to the top sub to extend into the housing and terminate intermediate of the top sub and drill bit support between the inner and outer ends thereof, a piston slidably received in the housing over the feed tube for reciprocation between a first position adjacent the top sub and a second position abutting the drill bit support, the one end portion of the piston adjacent the drill bit support having a reduced diameter and the inner walls of the housing adjacent the drill bit support having a reduced diameter portion substantially complementary to the one end portion of the piston, fluid porting means in the feed tube and piston to sequentially admit fluid into a first space between the top sub and the piston when the piston is at or near its first position and into a second space between the end portion of the piston, the wall of the housing and the inner end of the reduced diameter portion of the housing when the piston is at or near the second position, thereby causing the piston to reciprocate to the second and first positions respectively and further wherein the reduced diameter portions of the piston and the housing are engaged when at the second position and the end portion of the piston and the reduced diameter portion of the housing are disengaged when the piston is at an intermediate position between the first and second positions to allow for the escape of fluid from the second space through the fluid passageway.

2. A fluid operated hammer as claimed at claim 1 wherein the reduced diameter portion of the housing wall is provided by a removable annulus supported from the housing.

3. A fluid operated hammer as claimed at claim 1 wherein fluid from the first space is exhausted from the first space to the fluid passageways through the fluid porting means in the piston and the space between a central bore in the piston and the central tube when the piston is intermediate to the first and second position.

4. A fluid operated hammer as claimed at claim 2 wherein fluid from the first space is exhausted from the first space to the fluid passageways through the fluid porting means in the piston and the space between a central bore in the piston and the central tube when the piston is intermediate to the first and second position.

* * * * *